United States Patent [19]

Villavicencio et al.

[11] Patent Number: 4,635,322

[45] Date of Patent: Jan. 13, 1987

[54] FIBER WASHER

[75] Inventors: Eduardo J. Villavicencio, San Angel, Mexico; Jorge E. Arana, Bethesda, Md.

[73] Assignee: Process Evaluation and Development Corp., Dallas, Tex.

[21] Appl. No.: 663,591

[22] Filed: Oct. 22, 1984

[51] Int. Cl.[4] ..... D01B 3/10

[52] U.S. Cl. ..... 19/66 R; 8/156; 209/506

[58] Field of Search ..... 68/184, 177, 178; 8/156; 19/66 R, 7; 209/506, 18, 173; 210/196

[56] References Cited

U.S. PATENT DOCUMENTS

| | | | |
|---|---|---|---|
| 654,647 | 7/1900 | Koppelmann | 8/156 X |
| 1,150,464 | 8/1915 | Thame . | |
| 1,733,256 | 10/1929 | Gardner . | |
| 1,988,371 | 1/1935 | Chance | 209/173 X |
| 1,988,416 | 1/1935 | Freeman . | |
| 2,355,735 | 8/1944 | Kerr | 209/173 |
| 2,422,657 | 6/1947 | Cleveland | 209/173 X |
| 2,590,691 | 3/1952 | Fontein | 209/173 |
| 2,711,369 | 6/1955 | Birdseye | 92/1 |
| 2,711,822 | 6/1955 | Novak | 209/166 |
| 2,724,955 | 11/1955 | Spooner | 8/156 X |
| 2,737,435 | 3/1956 | Borck | 8/156 |
| 2,795,823 | 6/1957 | Wade | 19/66 |
| 2,895,176 | 7/1959 | Wade | 19/66 |
| 3,104,153 | 9/1963 | Ekegren | 8/156 |
| 3,367,495 | 2/1968 | Lea et al. | 209/163 |
| 3,498,088 | 3/1970 | Fleissner | 68/184 |
| 3,597,308 | 8/1971 | Brooks | 162/4 |
| 3,608,717 | 9/1971 | Strubel et al. | 209/172 |
| 3,637,490 | 1/1972 | Gardner et al. | 210/44 |
| 3,670,531 | 6/1972 | Thies et al. | 68/184 X |
| 3,690,358 | 9/1972 | Tilby | 146/119 |
| 3,698,212 | 10/1972 | Ameling et al. | 68/184 X |
| 3,698,949 | 10/1972 | Steppe et al. | 127/9 |
| 3,877,110 | 4/1975 | McCloskey et al. | 19/66 |

FOREIGN PATENT DOCUMENTS

| | | | |
|---|---|---|---|
| 3210972 | 10/1983 | Fed. Rep. of Germany | 209/173 |
| 1273788 | 9/1961 | France | 19/66 R |
| 405954 | 10/1943 | Italy | 209/173 |
| 15783 | of 1896 | United Kingdom . | |

*Primary Examiner*—Harvey C. Hornsby
*Assistant Examiner*—Frankie L. Stinson
*Attorney, Agent, or Firm*—Michael J. McGreal

[57] ABSTRACT

An improved fiber washer provides for a water recirculation technique which assists in moving the fibers through the washer and assists in the separation of heavy debris from the fibers.

7 Claims, 4 Drawing Figures

FIBER WASHER

This invention relates to an improvement in fiber washers which have an intermediate deepened section for the collection of heavy debris. More particularly, this invention relates to an improvement in a U-shaped fiber washer whereby heavy debris readily settles out away from the fibers and the fibers remain in a floating condition.

Fiber washers are used for many cleaning purposes. Considerable use is made of fiber washers in the textile and papermaking industries. In the papermaking industry, fiber washers are used when the non-wood fiber sources are to be the cellulose source. Typical non-wood fiber sources are bagasse, bamboo and straw. The fiber washer will remove dirt and other materials from the fiber source making the fiber more suitable for digestion and other processing to produce paper products.

This present invention is an improvement for fiber washers that have a deepened intermediate area for the collection of heavy debris which is removed from the fibers. This heavy debris consists primarily of dirt and small rocks which cling to the fiber material when it is being harvested. Any soluble materials will remain dissolved in the water which is periodically replaced in the washer. In particular, this invention is an improvement in the fiber washer of U.S. Pat. No. 3,877,110. This washer is of a U-shape design and has an intermediate deepened region at the apex of the U for the settling out of heavy debris. This heavy debris is removed at the bottom of this deepened region. The improvement to this type of washer consists of flowing water tangentially into the apex of the U so as to better flow the floating fiber through these regions and to provide a means for removing fine particles from the recycled water. In a further embodiment water under pressure is flowed upwardly into the fiber exit leg of the U shaped washer to move the fibers up onto the drain screen.

In brief summary, the present invention consists of modifying a fiber washer which has a deepened intermediate region to provide for the tangential flow of water into this deepened region. The water which is flowed to the deepened section is taken from the exit leg of the fiber washer and passed through a cyclone to remove fine particles. Additionally, it is preferred to flow some of this water upwardly into the exit leg of the washer at a point adjacent the deepened region.

The present invention will be disclosed in more detail with reference to the following drawings.

The invention will now be discussed in more detail with particular reference to the U-shaped washer of U.S. Pat. No. 3,877,110, which patent is incorporated herein by reference. However, the washer improvements, set forth in this application, apply to any washer which has an intermediate deepened region. That is, the fiber washer need not be of a U-shaped design.

Figure 1:
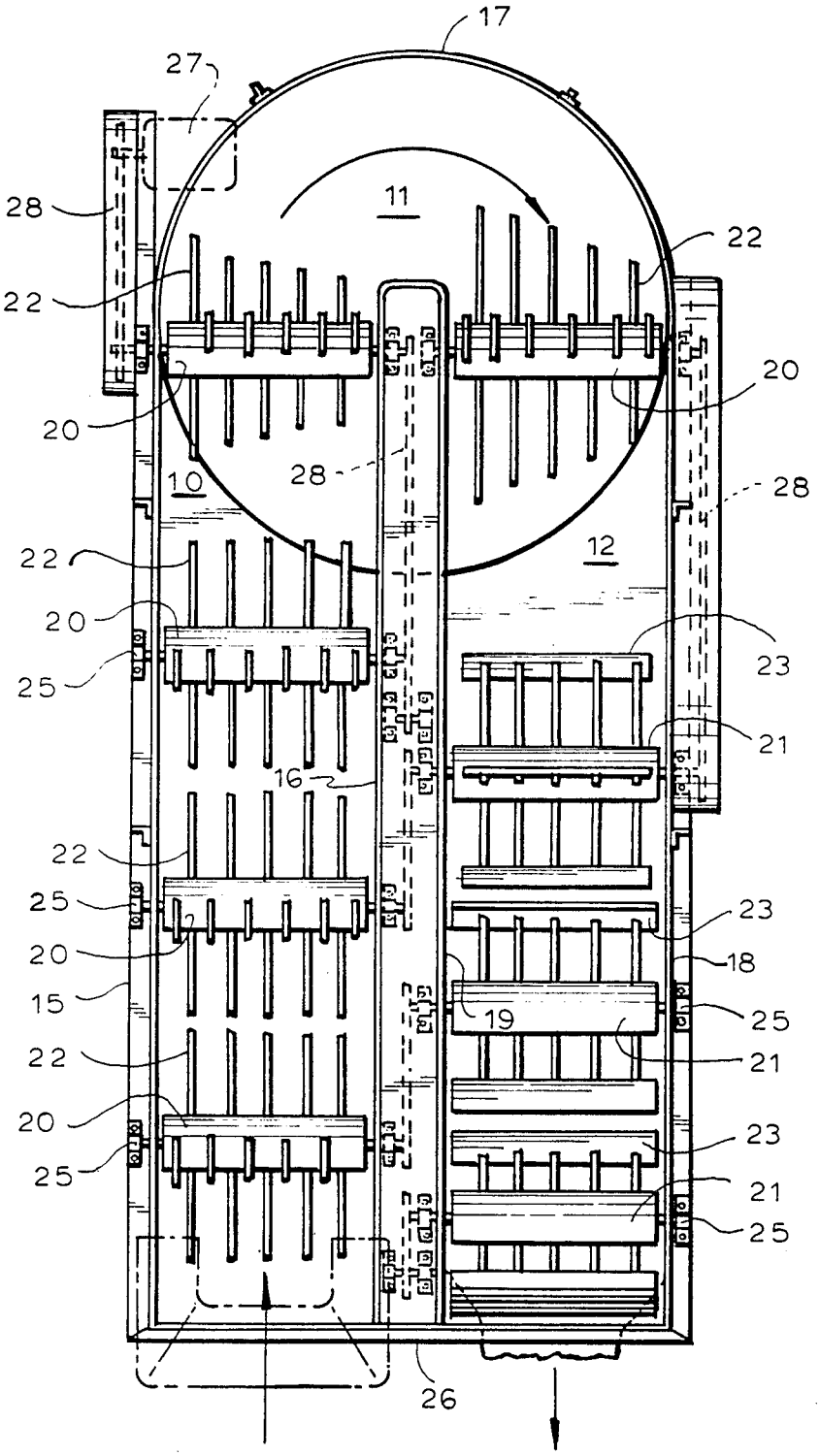
FIG. 1 is a plan view of a U-shaped washer incorporating the present tangential water flow improvement.

A very efficient fiber washer is shown in FIG. 1. This washer is U-shaped having fiber input leg 10, fiber exit leg 12 and deepened region 11 at the apex of the U of the washer. The input leg of the washer is defined by sides 15 and 16. Onto these sides are mounted spindles 20 which carry tines 22. These spindles are driven by electric motors and drive chains. Electric motor 27 drives the last spindle feeding fibers to the apex of the U shaped washer and via a chain drive 28 operates the preceding spindle. There is a separate electric motor for each two spindles with a chain drive 28 connecting the spindles. As an alternative, each spindle can have its own electric motor. Each spindle axle is mounted in a bearing 25 at sides 15 and 16. The two spindles which are over the deepened region 11 at the apex of the U have tines of varying length. This arrangement provides for an even flow of fiber. The exit leg 12 of the washer is defined by sides 18 and 19 and has three spindles 21 each of which carries paddles 23. The paddles move the fibers at a faster speed than tines which function to constantly submerse the fibers as well as to propel the fibers. Also, near the end of the exit leg, there is a raised screening on which the fibers are lifted as they exit the washer. This raised screening is shown in more detail in FIG. 2 as part 27 and functions to drain water from the fibers. The axle of each of these spindles has either an electric motor or chain drive mechanism. The axle of each spindle rides in bearings 25. The bearings are shown in more detail on the exterior side of the washer. Similar bearings are on the inner side. Preferably these are bearings which can easily be lubricated. End bulkhead 26 forms the end closure for both the input leg and the exit leg of the washer.

Figure 2:
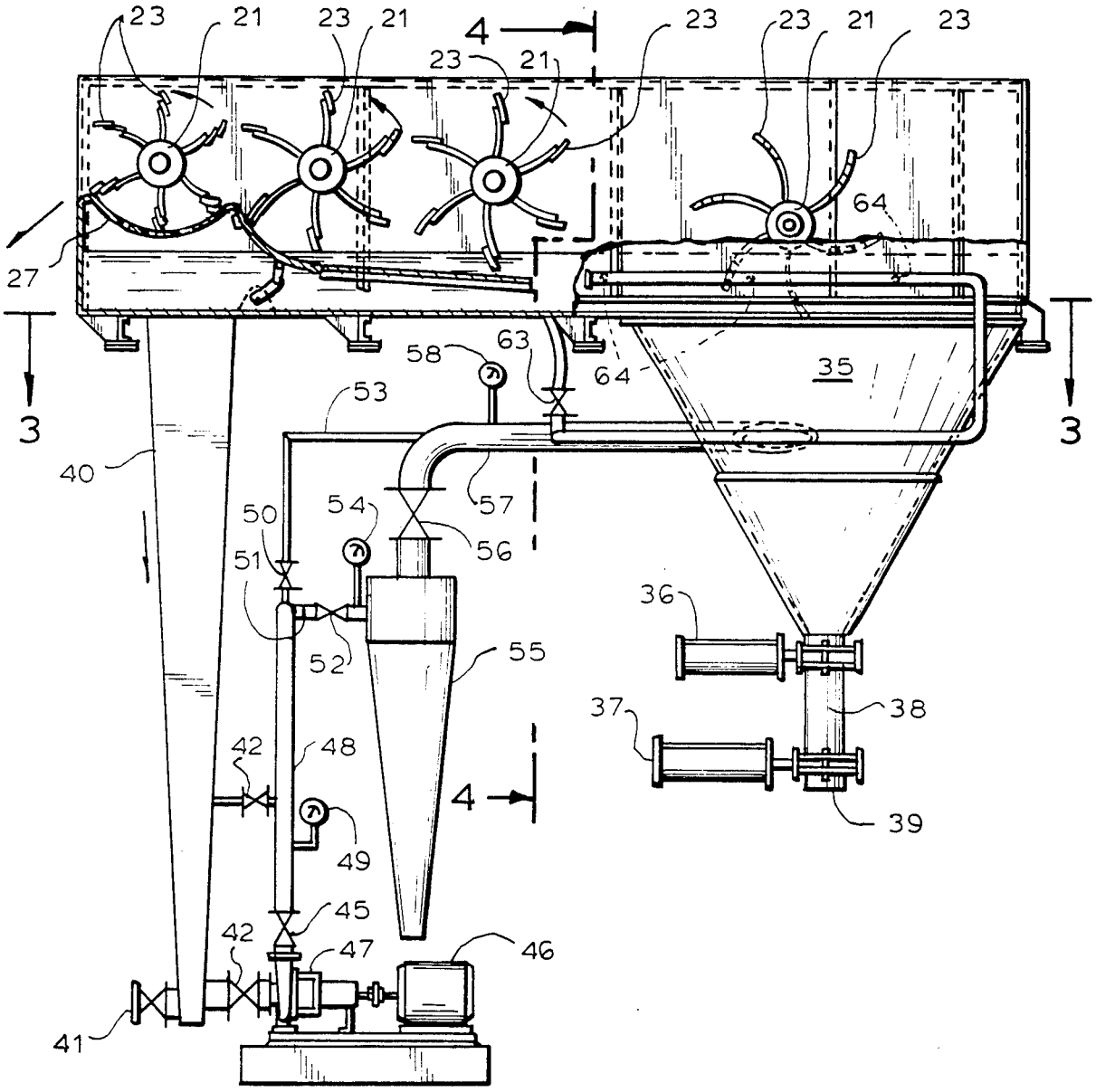
FIG. 2 is an elevational view of the exit leg of the washer in section showing the means for the tangential flow of water into the deepened region at the apex of the U.

FIG. 2 shows the exit leg 12 of the washer in detail. The spindles and paddles in the exit leg are shown in a manner which fully describes their operation. The fibers are constantly moved by the paddles toward and up draining screen 27. The washed fibers then exit the washer. This is also shown in U.S. Pat. No. 3,877,110. Also shown in this patent is the deepened region 11 and the dual valve means 36 and 37 to remove debris. As debris falls downward, it collects above gate valve 39. Valve 36 is opened and the debris falls into conduit 38. Valve 36 is closed and solenoid valve 37 opened whereby the dirt and debris exit at opening 39.

The improvement to this washer is set out in the water flow system mounted below the washer and to the side of the deepened region. Wash water is taken from the end of the exit leg of the fiber washer through conduit 40. This water is pumped by pump 47 driven by electric motor 46 through conduits 48 and 51 to hydrocyclone 55 which removes fine particles from the water and feeds this purified water through conduit 57 and tangentially into deepened region 11. It is preferred that conduit 57 be angled upwardly so that water flows into the deepened region in an upward direction. Conduit 60 takes water from conduit 57 and flows this water to openings 64 which are located in the exit leg of the washer adjacent the apex of the U. There is shown a number of valves and three pressure gauges in the system. The pressure gauges 49, 54 and 58 are for convenience in operating the system and are not required for operating the washer. These gauges will aid in troubleshooting problems. The valves serve various functions. Valve 41 is a clean-out drain valve for conduit 40. Valves 42 and 45 serve to isolate the pump so that it can be removed for servicing. Valve 43 controls the flow of water through bypass 44. Valves 50 and 52 control the flow of water to bypass 53 and to hydrocyclone 55.

Figure 3:
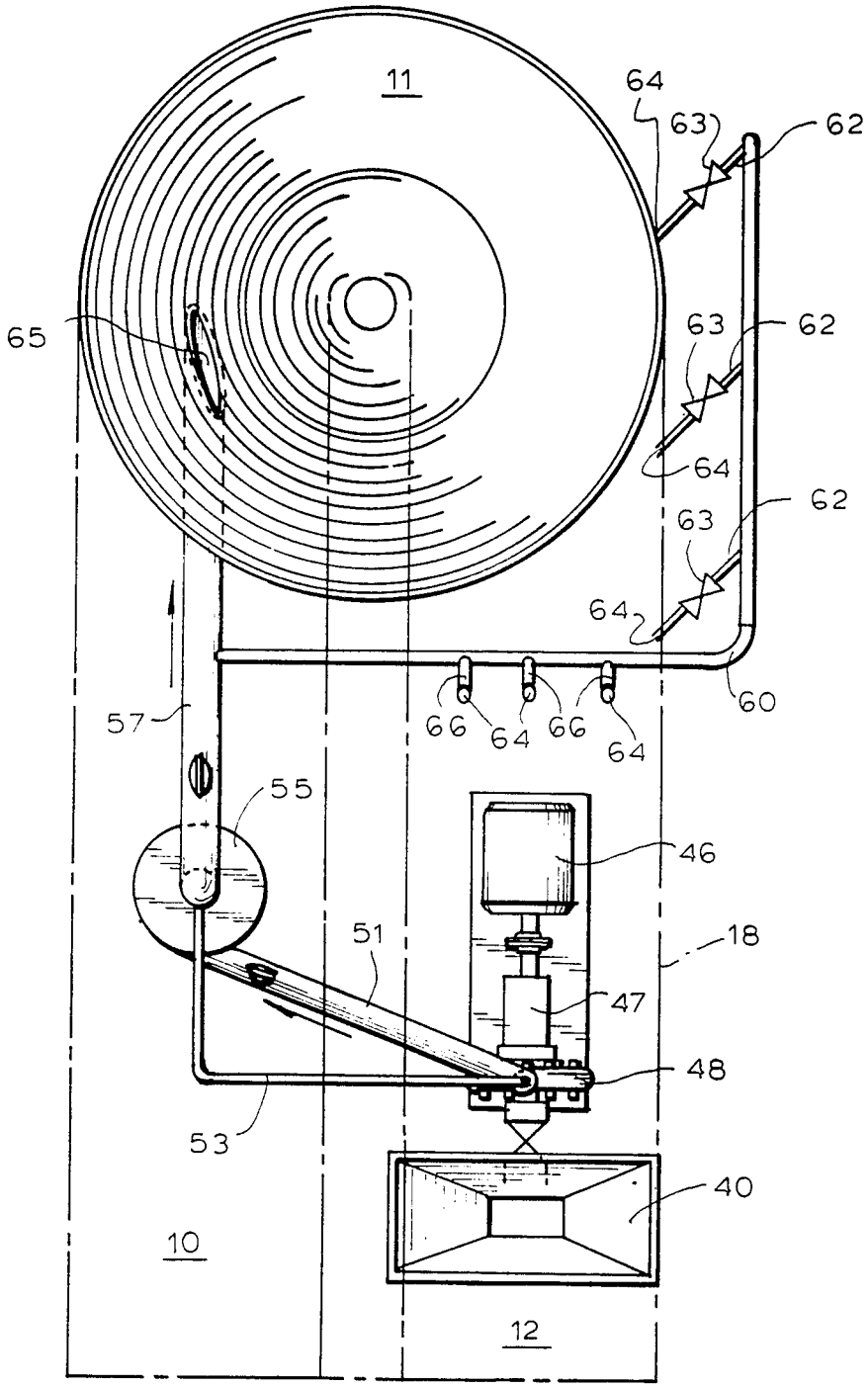
FIG. 3 is a top plan view of the water flow means to the deepened section of the U-shaped washer along line 3—3 of FIG. 2.

FIG. 3 shows the water flow system in more detail and particularly the tangential nature of the flow of water into the deepened region 11. This water flows through conduit 57 and enters the deepened region at 65. Also shown in more detail in this drawing, is the auxiliary water flow through conduit 60. Water from conduit 60 flows through connecting pipes 66 and 62 into the deepended region and the exit leg of the washer. Conduits 62 have valves 63 to permit regulating the flow of water. These flows of water assist in centering the fiber through the deepened region and into the exit leg of the washer. There is a tendency of the fiber to move to the outside wall of the washer in the apex of the U. This creates a drag on the fiber and slows the movement of the fiber through the washer.

Figure 4:
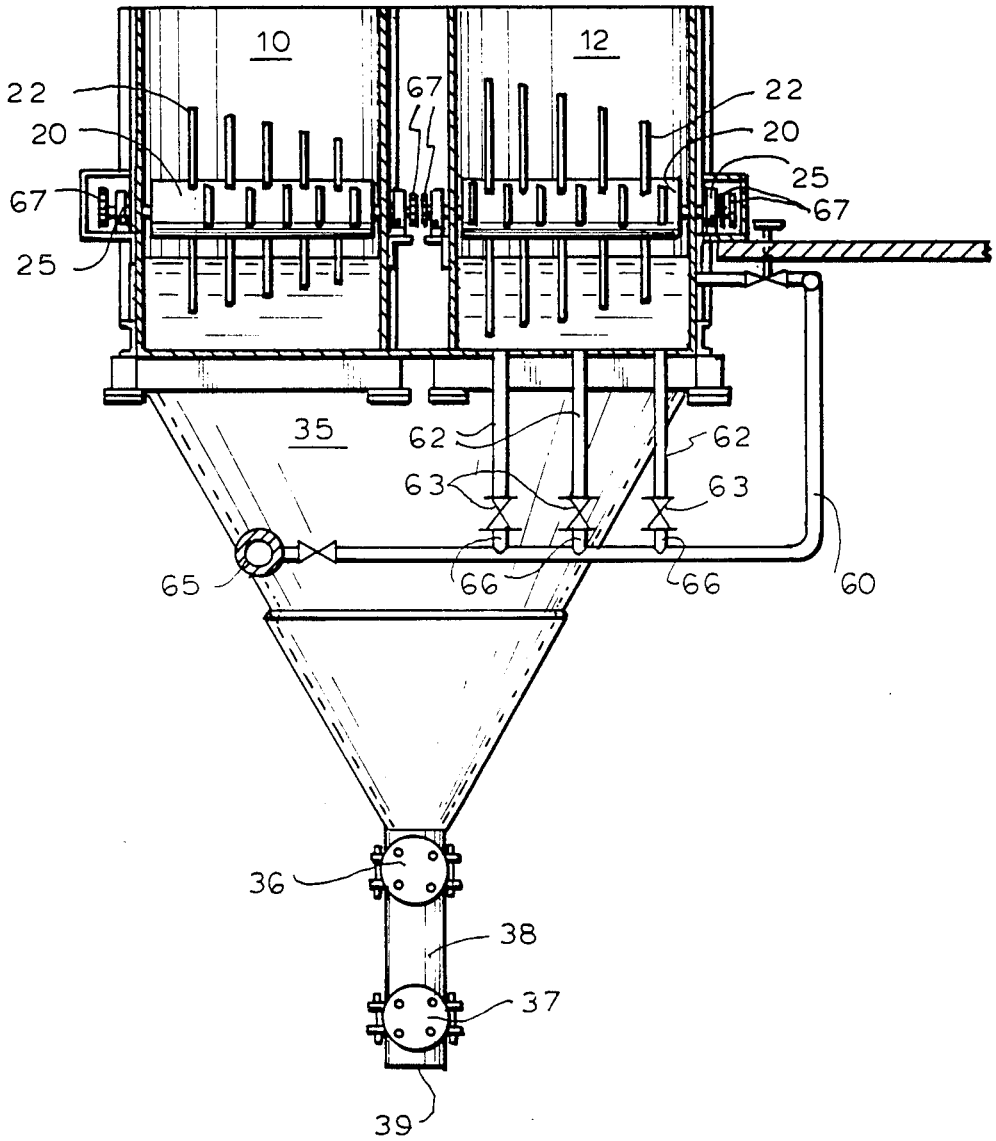
FIG. 4 is an elevational view of the exit leg of the U-shaped washer adjacent the deepened region along line 4—4 of FIG. 2.

FIG. 4 is a sectional view of the fiber washer taken at the intersection of the input leg/exit leg with the deepened region. This view, in particular, shows the flow of water from conduit 60 into the bottom of the exit leg of the washer adjacent the apex of the U. These flows of water serve to lift the fiber so that it will ride up onto drain screen 27 and to move the fiber toward the exit end of the washer. Also shown in this view are the drive chain sprockets on the spindles. The drive mechanism is shown in overall detail in FIG. 1.

In operation, the spindles are actuated as is the pump 47. Water is flowed through conduit 57 at a rate of about 200 to 300 gallons per minute at a pressure of about 30 to 50 psig. In this mode of operation, valves 42, 45, 52 and 56 are open. Dirt containing bagasse, bamboo or other fiber is then continuously flowed into the washer at the rate of about 150 tons per day. A typical washer will have inlet and exit leg dimensions of about 15 meters in length and about 1.5 meters in width. The deepened region will have a diameter of about 3 meters and a depth of about 2 meters. The tines on the spindles in the input leg constantly immerse the fibers and move the fibers toward the deepened region. The fibers, with the aid of the tangential water flow and auxiliary water flows, remain near the surface of the water and move through the deepened region and into the exit leg of the washer. The spindles carrying the paddles move the fibers toward and up the screen for draining and push the fibers out of the washer. The screen also prevents fibers from being drawn down conduit 40 and into the water flow system. Dirt and other debris is removed from time-to-time from the bottom of deepened area 11.

This water flow system serves two main functions. Firstly it provides a means to remove particle fines from the water. With the heavy particles being removed at the apex of the U of the washer, and the particulate fines removed by the hydrocyclone, a fairly pure water is recirculated. As a result, the water does not need changing as often. Secondly, by regulating the flows of water and directing the flows tangentially and upwardly in the apex of the U section and upwardly and toward the washer exit in the exit leg, the fiber is maintained near the surface of the water in the washer and in addition away from the walls of the washer, and particularly the washer walls in the apex of the U. The result is less water being used per day to wash fiber, less fiber loss through sinking in the deepened region in the apex of the U, and a decreased overall residence time of fiber in the washer. These are significant improvements, and particularly in washing bagasse fiber in preparation for pulping.

This improvement has been discussed with regard to a U-shaped washer. However, the improvement can be used on any equivalent washer. Also, the various washers which incorporate the improvement can be used to process more than bagasse or bamboo. Any dirty fiber material can be processed in the washer.

What is claimed is:

1. An improved U-shaped washer for cleaning fibrous materials comprising a plurality of roller mounted tines in one leg of said U-shaped washer to move said fibrous materials to the apex of the U-shaped washer while continuously submerging said fibrous materials; a deepened section at the apex of the U-shaped washer, and roller mounted paddles to move fiber from the apex of said U-shaped washer to the end of the other leg of said U-shaped washer, the improvement comprising means to remove water from the other leg of the U-shaped washer, cyclone means to remove particulate matter from the removed water, pump means to pressurize the removed water and conduit means to flow one part of said removed water tangentially into the apex of said U-shaped washer to thereby additionally propel fibrous materials through the apex of said U-shaped washer and another part upwardly into the other leg of said U-shaped washer to assist in centering the fibrous material in said other leg.

2. An improved washer for cleaning fibrous materials as in claim 1 wherein said means flows removed water into the other leg of said U-shaped washer at a plurality of locations.

3. An improved washer for cleaning fibrous materials as in claim 1 comprising particulate matter removal means after said pump to remove particulate material from the pressurized removed and treated water prior to flow tangentially into said U-shaped washer.

4. An improved method for washing a fibrous material using a U-shaped washer comprising feeding a fibrous material into one leg of said U-shaped washer, propelling said fibrous material to the apex of said U-shaped washer which is deepened to permit heavy solids to settle downwardly, and propelling said fibrous material to the end of the other leg of said U-shaped washer to remove the washed fibrous material therefrom, the improvement comprising removing water from the other leg of the U-shaped washer, treating said removed water to remove particulate matter therefrom flowing one part of said treated water tangentially into the apex of said U-shaped washer to propel the water around said apex and to prevent fibrous material from settling into the deepened areas in the apex of said U-shaped washer and flowing another part of said treated water upwardly into the other leg of said U-shaped washer to center the fibrous material in said other leg.

5. An improved method for washing a fibrous material as in claim 4 wherein removed and treated water is added to the other leg of the U at a plurality of locations.

6. An improved method for washing a fibrous material as in claim 5 wherein said fibrous material is bagasse.

7. An improved method for washing a fibrous material as in claim 5 wherein said fibrous material is bagasse.

* * * * *